United States Patent [19]

Morris et al.

[11] Patent Number: 4,828,454

[45] Date of Patent: May 9, 1989

[54] VARIABLE CAPACITY CENTRIFUGAL PUMP

[75] Inventors: Joseph H. Morris, Queenstown; Edmund J. Jarski, Potomac; Gregory E. Harris, Arnold, all of Md.

[73] Assignee: The United States of America as represented by the Secretary of the Navy, Washington, D.C.

[21] Appl. No.: 159,490

[22] Filed: Feb. 23, 1988

Related U.S. Application Data

[63] Continuation of Ser. No. 874,306, Jun. 6, 1986, abandoned.

[51] Int. Cl.[4] ..... F04D 15/00; F04D 29/28

[52] U.S. Cl. ..... 415/48; 415/131

[58] Field of Search ..... 415/21, 26, 48, 49, 415/131, 140, 141

[56] References Cited

U.S. PATENT DOCUMENTS

| | | | |
|---|---|---|---|
| 2,927,536 | 3/1960 | Rhoades | 415/48 |
| 2,957,424 | 10/1960 | Brundage | 415/48 |
| 3,329,095 | 7/1967 | Bartels | 415/131 X |
| 3,407,740 | 10/1968 | Samerdyke | 415/131 |
| 3,482,523 | 12/1969 | Morando | 415/49 X |
| 3,806,278 | 4/1974 | Grennan | 416/149 |
| 3,918,831 | 11/1975 | Grennan | 415/131 |
| 4,070,132 | 1/1978 | Lynch | 415/48 |
| 4,213,735 | 7/1980 | Grennan | 415/140 X |
| 4,378,194 | 3/1983 | Bandukwalla | 415/49 |
| 4,417,849 | 11/1983 | Morris | 415/131 |
| 4,419,046 | 12/1983 | Carlini | 415/127 |

FOREIGN PATENT DOCUMENTS

| | | | |
|---|---|---|---|
| 1093003 | 4/1955 | France | 415/141 |

*Primary Examiner*—Robert E. Garrett
*Assistant Examiner*—Joseph M. Pitko
*Attorney, Agent, or Firm*—Luther A. Marsh; John H. Stowe

[57] ABSTRACT

A variable capacity centrifugal pump capable of directly varying capacity, or output, in response to existing back pressure. The pump comprises a axially movable shroud having female grooves in fluid tight communication with male impeller vanes. The shroud has a top face surface in fluid communication with a control cavity which in turn is in fluid communication with pump back pressure.

8 Claims, 2 Drawing Sheets

VARIABLE CAPACITY CENTRIFUGAL PUMP

CROSS REFERENCE TO RELATED APPLICATIONS

This application is a continuation of application Ser. No. 06/874,306 filed June 6, 1986, now abandoned.

BACKGROUND OF THE INVENTION

The present invention relates to centrifugal pumps and more particularly to a centrifugal pump with a variable capacity.

In order to form centrifugal pumps it is known to make use of combinations comprising a case having an axial inlet, a rotating impeller, extending from a rotatable shaft and journaled for rotation in case bearings, which includes a plurality of impeller vanes, and a radial output surrounding the tips of the impeller vanes and in fluid communication with a toroidal-shaped collecter which in turn outlets into a pump casing throat.

Variable capacity centrifugal pumps in various forms are already known and disclosed in U.S. Pat. Nos. to: Morris 4,417,849; Grennan 3,806,278; Grennan 3,918,831; Lynch 4,070,132; Bandukwala 4,378,194; Carlini 4,419,046; Morando 3,482,523; Rhoades 2,927,536; and French Patent No. 1,093,003.

A typical approach in providing a centrifugal pump with variable capacity involves varying the width of the impeller flow passages, impeller flow passages define the fluid passages between adjoining impeller vanes. This width adjustment of the impeller flow passage is initiated by measuring the existing back pressure in a casing throat and adjusting the impeller flow passage width, to either increase or decrease pump output to meet output demands, through an intermediate system. This intermediate system results in a less than ideal pump capacity adjustment in the responsive sense. Intermediate systems also add to the cost of the pump due to their complicated nature.

In Morando, a variable capacity centrifugal pump is shown wherein the variable capacity is controlled by attaching a movable shroud to a shaft which is concentric with the shaft which drives the impeller. The movable shroud is displaced by means of a piston attached to the shaft, the piston operative in a chamber substantially isolated from the rotating shroud. In Rhoades, a movable shroud also varies the capacity of the pump. As in Morando, the piston which causes translation of the shroud with respect to the impeller is operative in a chamber isolated from the functional area of the shroud, the movable shroud supported in rotation primarily by the casing and is engaged for rotation drive by the impeller. In French Patent No. 1,093,003, variable capacity is accomplished by mechanically displacing either the impeller or the movable shroud.

SUMMARY OF THE INVENTION

Accordingly, the present invention provides a variable capacity centrifugal pump that adjusts the width of the impeller flow passage directly in response to pump back pressure.

It is therefore an object of the present ivention to eliminate the need for an intermediate system in varying pump impeller flow passage width.

Another object of the present invention is to provide a variable capacity centrifugal pump that is relatively inexpensive to manufacture.

Yet another object of the present invention is to provide a variable capacity centrifugal pump that is inherently reliable due to its simplicity of design.

A more complete appreciation of the invention and many of the attendant features thereof will be readily appreciated as the same becomes better understood by reference to the following detailed description when considered in connection with the accompanying drawings wherein:

DETAILED DESCRIPTION OF THE PREFERRED EMBODIMENT

Figure 1:
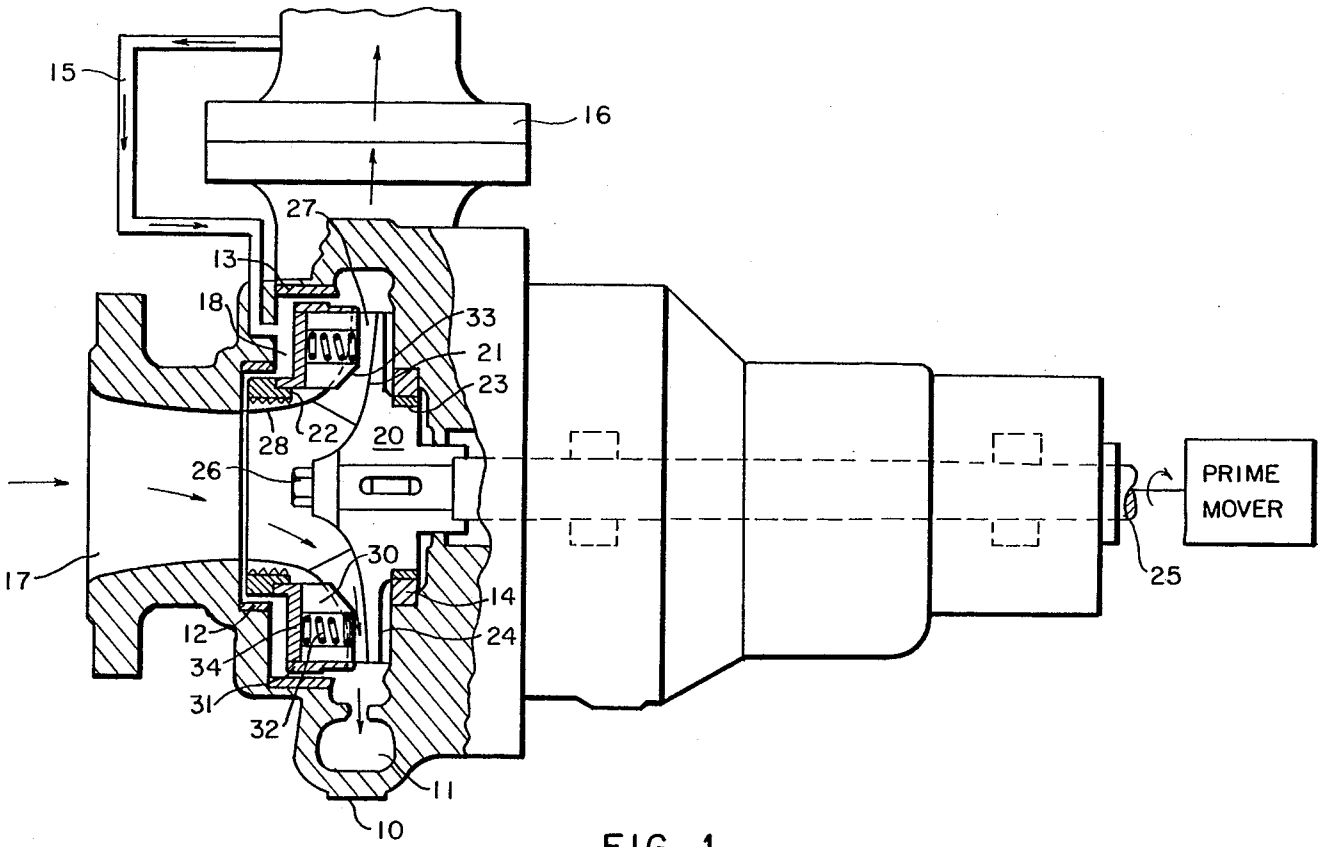
FIG. 1 is a cut away plan schematic view of the variable capacity centrifugal pump of the present invention.

With reference now to FIG. 1 a variable capacity centrifugal pump in accordance with the preferred embodiment of the present invention comprises an axial casing inlet 17, a rotating impeller 20 which includes a plurality of impeller vanes 21 and a casing 10 which defines a radial output surrounding the tips of the impeller vanes 21. Impeller 20 is keyed, not numbered, to the pump shaft 25 and is held on the shaft 25 by means of a lock nut 26. Pump shaft 25 is journalled in case bearings, not numbered, for rotation. Pump shaft 25 is caused to rotate by a prime mover, not numbered. Impeller 20 is substantially of a hollow conical shape axially open at a forwardly extending portion 28 and radially open at rearwardly extending portion. The axial open and radial open portions are internally connected by a series of impeller vanes 21. Impeller flow passages 27 are located between adjoining vanes 21 and provide channeling for fluid entering at the impeller axial opening and forced out the impeller radial opening, under the effects of the rotating impeller 20. In operation fluid is introduced into the casing axial inlet 17, channeled along impeller flow passages 27 and outputted in the casing 10 which defines the radial output surrounding the tips of the impeller vanes 21 and is then collected, in a discharge pressure state, in a toroidal collector 11. Toroidal collector 11 is in fluid communication with a pump back pressure.

The width of the impeller flow passages 27, and hence the capacity of the pump, of the impeller 20 are varied by means of a movable shroud 30, as will be discussed more fully hereinafter.

A conventionally loaded bottom impeller wear ring means 14 and 23 is disposed about a rearwardly extending portion of the impeller 20, as shown between the impeller 20 and the pump casing 10, for the purpose of sealing the fluid discharge pressure, in the toroidal collector 11 to the impeller back face 24. Wear ring means 14 and 23 is thus located to balance axial thrust loads.

The bottom impeller wear ring means 14 and 23 comprises an impeller ring 23 fixedly attached to the impeller 20 and/or a casing ring 14 fixedly attached to the casing 10 and coaxial with the surrounding the impeller ring 23. A labyrinth seal may be employed rather than wear ring means if deemed desirable or necessary.

As may be seen from FIG. 1, the impeller 20 and movable shroud 30 are telescopingly related and even in the maximum width impeller flow passage condition, as will be discussed more fully hereinafter, there is sufficient bearing area for the movable shroud 30 to be caused to rotate with the drive shaft 25; torque being transmitted to the movable shroud 30 via the impeller 20. Movable shroud 30 is generally ring shaped and fits around the forwardly extending portion 28 of the impeller 20.

A conventionally loaded top impeller wear ring means 12 and 22 is disposed is disposed about the forwardly extending portion 28 of the impeller 20, as shown between the impeller 20 and the pump casing 10 for the purpose of sealing the fluid back pressure to the movable shroud top face 34. The top impeller wear ring means 12 and 22 comprises an impeller ring 22 fixedly attached to the impeller 20 and/or a casing ring 12 fixedly attached to the casing 10 and coaxial with and surrounding the impeller ring 23. Impeller ring 22 is threaded on its inner diameter to threadedly engage threads provided on the outer peripheral surface of impeller forwardly extending surface 28, thereby retaining movable shroud 30 on the impeller 20.

Figure 2:
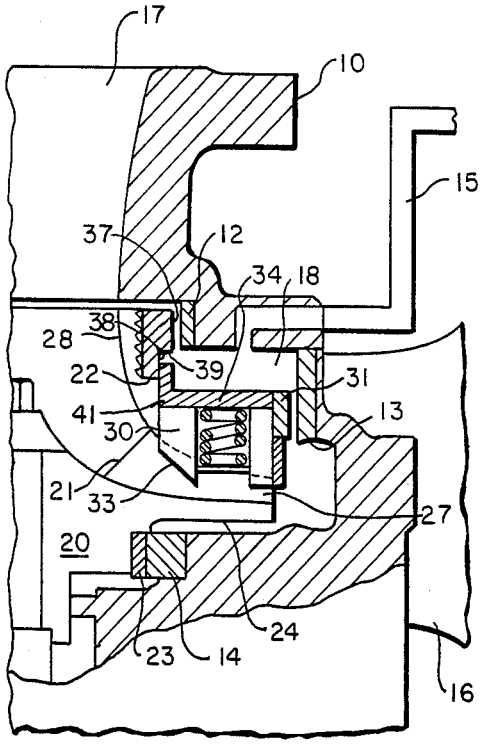
FIG. 2 is an enlarged partial schematic view showing the pump of FIG. 1 operating at a different capacity.

Impeller ring 22 has a first and second outer diameters 37 and 38, respectively. First outer diameter 37 of impeller ring 22 rotates in a close rotational relationship with top impeller wear ring 12. Second outer diameter 38 of impeller ring 22 is smaller than first outer diameter 37 thereby forming step 39 as shown in FIG. 2. Movable shroud 30 has inwardly facing diameter 41 which slidingly engages the second outer diameter of impeller ring 22. Step 39 of impeller ring 22 and second outer diameter 38 form a shroud retainer for retaining and positioning shroud 30 on impeller 20.

As is indicated above impeller 20 is fitted with an axially movable shroud 30. Movable shroud 30 is a substantially solid ring like member manufactured with female grooves 33, on its bottom surface, which form a fluid tight seal with the fixed vanes and impeller flow passages 27 on the impeller 20. To change the impeller vane flow passage width the movable shroud 30 moves axially relative to the fixed impeller 20. The movable shroud is inserted to the maximum depth of the impeller vane flow passages 27 for minimum impeller flow passage width as shown in FIG. 2, and are almost entirely withdrawn from the impeller flow passages 27 for maximum impeller flow passage width as shown in FIG. 1. Because the movable shroud is not a pumping element, and therefore does not require provisions for transmission of high power levels, it can be lightweight thus simplifying balancing location and bearing loading problems.

A conventionally loaded movable shroud wear ring means 13 and 31 is disposed about the outer periphery of the movable shroud 30, as shown between the movable shroud 30 and the pump casing 10 for the purpose of sealing the fluid back pressure to the movable shroud top face 34 thus creating a control cavity 18 in communication with the movable shroud's top face 34. Control cavity 18 is between movable shroud wear ring means 13 and 31 and the top impeller wear ring means 12 and 22.

The movable shroud wear ring means 13 and 31 comprises a movable shroud ring 31 fixedly attached to the movable shroud and/or casing ring 13 fixedly attached to the casing 10. Casing ring 13 is wide enough to remain coaxial with and surround the movable shroud ring for the entire reciprocal axial travel of the movable shroud 30.

In operation fluid discharged radially outward from the impeller flow passages 27 defined by the impeller vanes 21 and the mating movable shroud 30 is received in the collector 11, containing a fluid discharge pressure, which is in fluid communication with casing throat 16, containing a fluid back pressure. Fluid back pressure is put in fluid communication with the top face 34 of movable shroud 30 by means of a pipe means 15 for fluidedly connecting the back pressure within the casing throat 16 with control cavity 18.

By feeding fluid back pressure into the control cavity 18, the movable shroud 30 will sense a back pressure force. If the fluid back pressure in casing throat 16 increases, the control cavity pressure increases as well forcing the movable shroud 30 into a minimum impeller flow passage width as shown in FIG. 2. Likewise if the fluid back pressure in casing throat 16 decreases, movable shroud 30 is biased into a maximum impeller flow passage width by movable shroud biasing means 32, such as coil springs situated between movable shroud female grooves 33 and impeller vanes 21. Through use of the fluid back pressure in casing throat 16 leading into the control cavity 18, the movable shroud can be positioned wherever needed to control pump throughout rate. This is done directly and results in a very responsive pump capacity adjustment.

Obviously numerous modifications of the present invention are possible in the light of the above teachings. It is therefore to be understood that within the scope of the appended claims the invention may be practiced otherwise than as specifically described therein.

What is claimed is:

1. A variable capacity centrifugal pump, comprising:

a casing having an axial fluid inlet means and a radial fluid outlet means;

an impeller, rotationally disposed in said casing, said impeller having a plurality of impeller vanes and flow passages with axial inlet and radial outlet for channeling said fluid under the effects of said rotating impeller, said impeller sealedly disposed in said casing means by a close rotational relationship between said impeller means and said casing means;

a substantially solid annular movable shroud for varying the volume of said flow passages, said movable shroud further comprising a first surface having a plurality of grooves, said grooves for receiving the vanes of said impeller in a meshing relationship, and a second surface disposed axially from said first surface, said second surface lying in a plane orthogonal to the axis of rotation of said impeller, said movable shroud sealedly disposed in said casing means by a close rotational relationship between said movable shroud and said casing means;

a shroud retainer affixedly attached to said impeller, said movable shroud maintained in assembled relation and in rotational alignment with said impeller by said shroud retainer, said shroud retainer adapted to permit said movable shroud to translate axially with respect to said impeller, said shroud retainer sealedly disposed in said casing means by a close rotational relationship between said shroud retainer and said casing means; and, an annular hydraulic cavity in fluid communication with the output of said pump, one boundary of said cavity in a hydraulic pressure contacting relation with said second surface of said movable shroud.

2. A variable capacity centrifugal pump as claimed in claim 1 wherein said close rotational relationship between said casing means and said impeller further comprises a labyrinth seal.

3. A variable capacity centrifugal pump as claimed in claim 1 wherein said close rotational relationship between said casing means and said movable shroud further comprises a labyrinth seal.

4. A variable capacity centrifugal pump as claimed in claim 1 wherein said close rotational relationship between said casing means and said shroud retainer further comprises a labyrinth seal.

5. A variable capacity centrifugal pump, comprising:

a casing having an axial fluid inlet means, a radial fluid outlet means and first, second and third radially inward wear surfaces, said first radially inward wear surface disposed more axially inward from said axial fluid inlet means than said second and third radially inward wear surfaces and said second radially inward wear surface disposed more axially inward from said axial fluid inlet means than said third radially inward wear surface;

an impeller, rotationally disposed in said casing, said impeller having a plurality of impeller vanes and flow passages with axial inlet and radial outlet for channeling said fluid under the effects of said rotating impeller and a radially outward wear surface, said impeller sealedly disposed in said casing means by a close rotational relationship between said radially outward wear surface of said impeller and said first radially inward wear surface of said casing means;

a substantially solid annular movable shroud for varying the volume of said flow passages, said movable shroud further comprising a first surface having a plurality of grooves, said grooves for receiving the vanes of said impeller in a meshing relationship, and a second surface disposed axially from said first surface, said second surface lying in a plane orthogonal to the axis of rotation of said impeller, said movable shroud further comprising a radially outward wear surface, said movable shroud sealedly disposed in said casing means by a close rotational relationship between said radially outward wear surface of said movable shroud and said second radially inward wear surface of said casing means;

a shroud retainer affixedly attached to said impeller, said movable shroud maintained in assembled relation and in rotational alignment with said impeller by said shroud retainer, said shroud retainer adapted to permit said movable shroud to translate axially with respect to said impeller, said shroud retainer further comprising a radially outward wear surface, said shroud retainer sealedly disposed in said casing means by a close rotational relationship between said radially outward wear surface of said shroud retainer and said third radially inward wear surface of said casing means; and an annular hydraulic cavity in fluid communication with the output of said pump, one boundary of said cavity in a hydraulic pressure contacting relation with said second surface of said movable shroud, said cavity further bounded by the close rotational relationship between said radially outward wear surface of said movable shroud and said second radially inward wear surface of said casing means and said close rotational relationship between said radially outward wear surface of said shroud retainer and said third radially inward wear surface of said casing means.

6. A variable capacity centrifugal pump as claimed in claim 5 wherein said close rotational relationship between said first radially inward wear surface of said casing means and said radially outward wear surface of said impeller further comprises a labyrinth seal.

7. A variable capacity centrifugal pump as claimed in claim 5 wherein said close rotational relationship between said second radially inward wear surface of said casing means and said radially outward wear surface of said movable shroud further comprises a labyrinth seal.

8. A variable capacity centrifugal pump as claimed in claim 5 wherein said close rotational relationship between said third radially inward wear surface of said casing means and said radially outward wear surface of said shroud retainer further comprises a labyrinth seal.

* * * * *